US006464539B2

(12) United States Patent
Yoshida et al.

(10) Patent No.: US 6,464,539 B2
(45) Date of Patent: Oct. 15, 2002

(54) LAMP FITTING STRUCTURE

(75) Inventors: Tatsumi Yoshida; Tetsuya Kudo; Kazuya Terada, all of Iwaki; Shigehiro Kobayashi, Ichikawa; Shigeaki Watanabe, Hara-Machi; Hiroyuki Chikama, Tokyo, all of (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 09/788,665

(22) Filed: Feb. 21, 2001

(65) Prior Publication Data

US 2001/0051462 A1 Dec. 13, 2001

(30) Foreign Application Priority Data

Feb. 25, 2000 (JP) ..... 2000-048491

(51) Int. Cl.[7] ..... H01K 1/00
(52) U.S. Cl. ..... 439/619; 439/699.2; 439/617
(58) Field of Search ..... 439/619, 617, 439/699.1, 699.2

(56) References Cited

U.S. PATENT DOCUMENTS 4,592,615 A * 6/1986 Durand ..... 439/619
4,647,132 A * 3/1987 Mikola ..... 439/699.2

FOREIGN PATENT DOCUMENTS

| | | |
|---|---|---|
| JP | 6-19171 | 5/1994 |
| JP | 6-31667 | 8/1994 |

* cited by examiner

*Primary Examiner*—Tho D. Ta
(74) *Attorney, Agent, or Firm*—Morgan, Lewis & Bockius LLP

(57) ABSTRACT

A lamp fitting structure having a small depth dimension can include a socket for fixing a wedge-base lamp. The socket can include an insertion portion for receiving and fitting a fixed portion of the lamp therein, a peripheral portion and a rear end portion on the back face, all integrally formed. An opening can be provided which penetrates through from the insertion portion to the rear end portion. The socket does not require an electrical feed terminal for electrical connection, and only performs fixation of the inserted lamp A connector can be fitted into the opening in the rear end portion, for electrically connecting the feed terminal disposed in the connector to a lead wire of the wedge-base lamp. By inserting and fitting the connector into the socket from the rear end portion thereof the fixation between the wedge-base lamp and the socket can be made more secure. As a result, the depth dimension can be reduced, and a fitting structure that is easily operated can be provided,

20 Claims, 5 Drawing Sheets

LAMP FITTING STRUCTURE

BACKGROUND OF THE INVENTION

1. Field of the Invention

The present invention relates to a lamp socket structure and particularly relates to a lamp socket structure for fitting a lamp that has no base, e.g., a wedge-base lamp.

2. Detailed Description of the Related Art

Prior to describing a conventional fitting structure, the wedge-base lamp will be described. The wedge-base lamp 1 can be made of glass and include a bulb portion 2*a* and a fixed portion 2*b*, as shown in FIG. 8. A filament 5 formed of tungsten or the like can be provided in a prescribed location inside the cylindrical bulb portion 2*a*, and is connected to the tip end of lead wires 4.

The lead wires 4 can be fixed with a stem 6 in the bulb portion 2*a*, sealed by the fixed part 2*b*, and guided outside from the bottom end of the bulb. The portions of the lead wires 4 that are guided outside are respectively folded to the surface side and the backside of the fixed portion 2*b*.

In the fixed portion 2*b*, a plurality of protrusions 3 are integrally provided at predetermined positions. The wedge-base lamp does not have a base as provided in normal incandescent lamps.

The external diameter of the bulb portion can be changed from, for example, 10 mm, 13 mm, to 16 mm or the like to thereby increase the internal volume to change the brightness thereof The outer diameter dimension of the fixed portion remains unchanged in each of these configurations, so that a socket of a common dimension can correspond to lamps having a plurality of bulb diameters.

FIG. 8 to FIG. 10 show a conventional connection structure of a wedge-base lamp and a socket.

The socket 90 is configured to secure a wedge-base lamp 1 and to feed power thereto, and includes an opening 90*a* for receiving the wedge-base lamp, an outer peripheral portion 90*b* and a rear end portion 90*c*. Wedge-base lamp terminals 80 that are configured for feeding power to the wedge-base lamp can be inserted into the opening 90*a* side, and terminal feet 81 are disposed on the rear end portion 90*c* side, through a compartment portion 90*d*.

The wedge-base lamp terminal 80 includes the terminal foot 81 and a terminal portion 82, and can be formed by pressing a metal plate by a die, and folding it. The metal plate can be made of, for example, copper alloy having a thickness of 0.3 mm. The terminal portion 82 includes feed pawls 82*a* that clamp the fixed part 2*b* of the wedge-base lamp 1 therebetween and are brought into contact with the lead wire 4. The tips of the feed pawls 82*a* can be folded inwardly three-dimensionally so as to face each other. The terminal foot 81 is connected to an external connection code via a connector (not shown) that is inserted from the rear end portion 90*c* side.

When the wedge-base lamp 1 is inserted into the socket opening 90*a*, as shown in FIG. 10, the feed pawls 82*a* clamp the fixed portion 2*b* of the wedge-base lamp 1 from opposite sides and are brought into contact with the lead wire 4 to feed power to the lamp.

Fixation and feeding of electricity are performed by inserting and fitting the wedge-base lamp to the socket. However, terminal feet 81 (i e., feed terminal) that extend downward can be provided for feeding electricity to the lower part of the socket. Accordingly, installation space for connection with a separate connector is required, and hence the size of the rear end portion 90*c* is relatively large. In addition, a relatively large space is required for fixation of the socket with a connector, causing a problem in that the depth dimension becomes large.

SUMMARY OF THE INVENTION

It is an object of the present invention to solve at least the above-described problems and to provide a fitting structure in which the depth dimension can be made small. In addition, it is an object of the invention to reduce the number of parts necessary to construct a socket and to reduce the overall cost of the socket.

In order to achieve the above-mentioned objects, according to a first aspect of the present invention, there is provided a wedge-base lamp fitting structure having a wedge-base lamp that includes a bulb portion, a fixed portion having no base and a lead wire at the fixed portion, a socket including an insertion portion for receiving and fitting the fixed portion therein, and a connector inserted and fitted into a rear end portion of the socket, wherein the socket includes an insertion portion having a rectangular cylindrical opening with substantially the same length as that of the fixed portion in an oblong rectangular shape, and a rear end portion provided on the back side of the insertion portion, with the insertion portion and the rear end portion being provided with a continuous opening. The insertion portion can have a side slit formed on the narrow side, with the opening having a plurality of pushing pieces and positioning protrusions provided therein. When the fixed portion of the wedge-base lamp is inserted into the opening in the insertion portion, the pushing pieces and positioning protrusions abut against the fixed portion of the wedge-base lamp, and the fixed portion is fixed with a gap between the inner face of the opening of the insertion portion and the lead wire, The connector formed in a separate body can be inserted and fitted into the gap through the opening in the rear end portion, to thereby connect a feed terminal provided in the connector and the lead wire.

According to an aspect of the invention, the wedge-base lamp is fixed by the socket, and secured more firmly by attaching the connector to the socket. Moreover, the feed terminal of the connector is connected to the lead wire of the wedge-base lamp. As a result, fitting becomes easier, and the depth dimension can be made smaller.

The above objects can be also achieved by a wedge-base lamp fitting structure according to other aspects of the present invention as described below.

According to another aspect of the present invention, there is provided the wedge-base lamp fitting structure, wherein the insertion portion and the rear end portion are integrally formed, both using a resin material having elasticity.

According to another aspect of the present invention, there is provided the wedge-base lamp fitting structure. wherein the depth of the side slit is substantially two thirds of the height of the fixed portion.

According to another aspect of the present invention, there is provided the wedge-base lamp fitting structure, wherein die pushing pieces are provided in each long side of the insertion portion. The positioning protrusions can be provided in at least three prescribed locations at positions on the rear end portion side than the pushing pieces, and a protrusion quantity of the positioning protrusion into the opening is smaller than a protrusion quantity of the pushing pieces.

According to another aspect of the present invention, there is provided the wedge-base lamp fitting structure, wherein the opening is made such that the sectional area in the rear end portion side is larger than that in the insertion portion.

The wedge-base lamp fitting structure can be formed integrally, thereby lowering cost. By making the depth of the slit about two thirds of the height of the fixed portion, the socket secures the wedge-base lamp with an adequate spring property, to thereby make the fitting workability with the connector easier. Since the pushing pieces can clamp the fixed portion from opposite sides at a position where the lead wire is provided in a prescribed location on the bulb side of the wedge-base lamp, and the fixed portion can also be secured by the positioning protrusions provided on the tip side of the fixed portion, play of the fixed portion can be reduced. The opening on the rear end portion side can also be made large, thereby enabling easy execution of the connection operation with the connector.

BRIEF DESCRIPTION OF THE DRAWINGS

The above and other objects, features and advantages of the present invention will be apparent from the following detailed description of the preferred embodiments of the: invention in conjunction with the accompanying drawings, in which.

PREFERRED EMBODIMENTS OF THE INVENTION

Preferred embodiments of the present invention will now be described in detail, with reference to FIG. 1 to FIG. 7.

Figure 1:
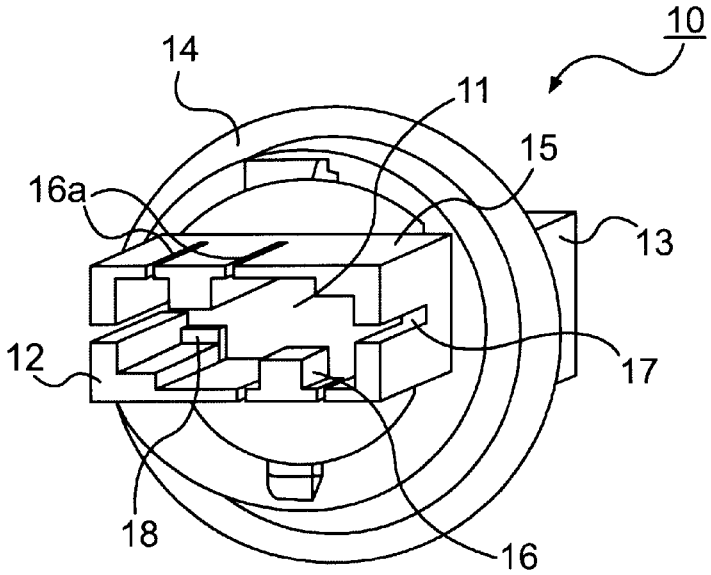
FIG. 1 is a perspective view showing one embodiment of a socket in a fitting structure according to the present invention.

FIG. 1 shows a construction of one embodiment of a wedge-base lamp fitting structure according to the present invention, A socket 10 can include an insertion portion 12 (for receiving and fitting a wedge-base lamp), a rear end portion 13 and an outer peripheral portion 14.

The insertion portion 12 is preferably formed in a rectangular cylindrical shape by arranging a raising wall 15 in an oblong rectangular shape and standing away from the outer peripheral portion 14. The insertion portion 12 can be formed of a material having elasticity, such as PET (polyethylene terephthalate), PPS (polyphenylene sulfide), and PBT (polybutylene terephthalate) resin. A side slit 17 can be formed in the narrow side of the raising wall 15, and pushing piece slits 16*a*, pushing pieces 16 and bottom positioning protrusions 18 can be formed in the long side thereof Since the raising wall 15 is formed of an elastic material, formation of these slits gives it a proper spring property. In addition, an opening 11 can be provided from the insertion portion 12 up to the rear end portion 13.

Figure 2:
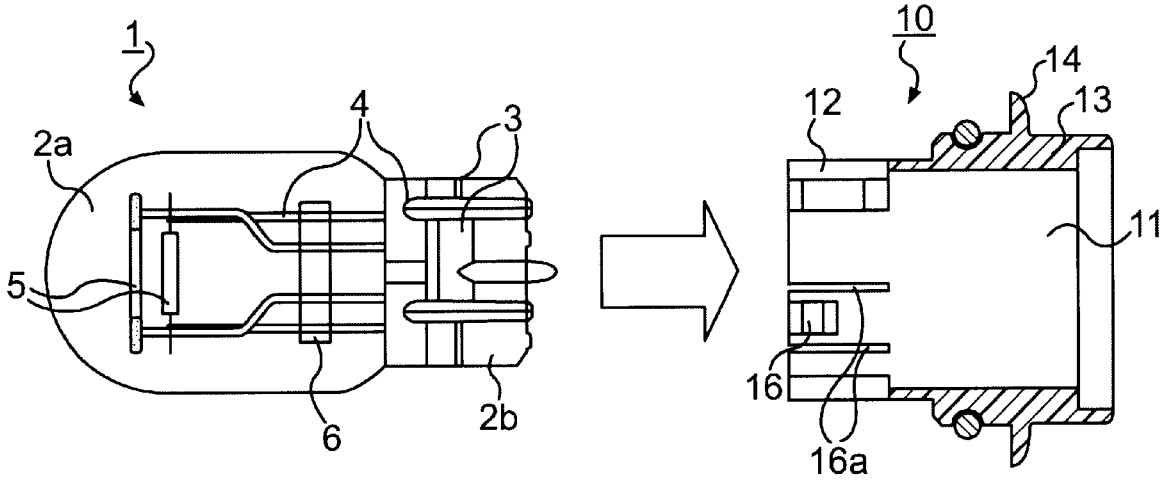
FIG. 2 is a side view, of a lamp and a sectional view in the long side direction of the socket in FIG. 1.
Figure 3:
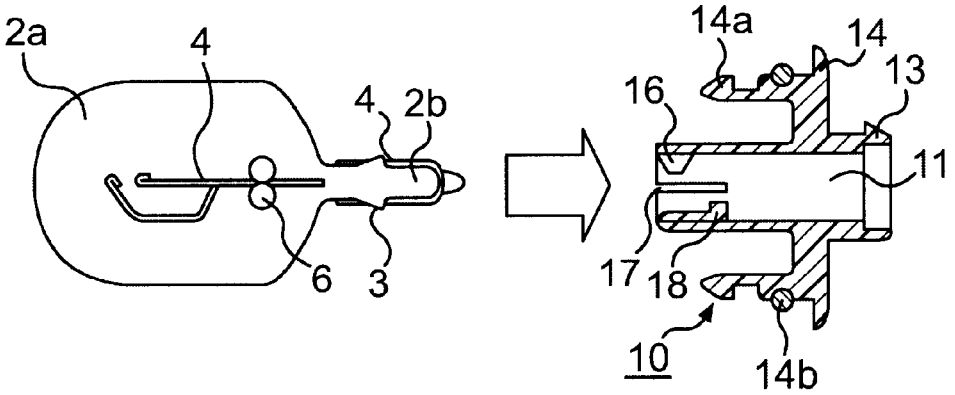
FIG. 3 is a side view of a lamp and a sectional view in the narrow side direction of the socket in FIG. 1.
Figure 4A:
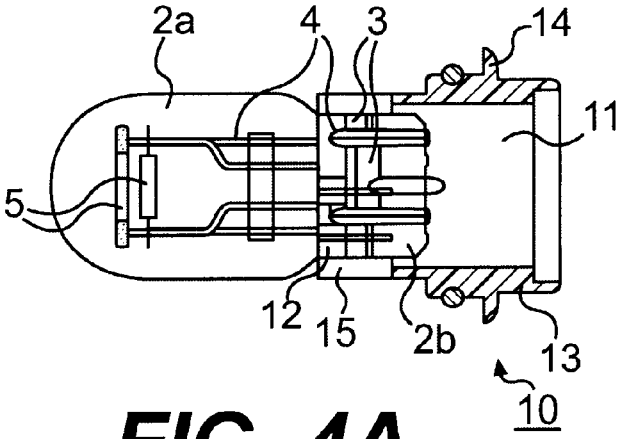
FIGS. 4(*a*) and 4(*b*) are diagrams showing the fitting condition of the socket in FIG. 1 with the wedge-base lamp, where FIG. 4(*a*) is a side view of the lamp and a sectional view of the socket, and FIG. 4(*b*) is a backside view.
Figure 4B:
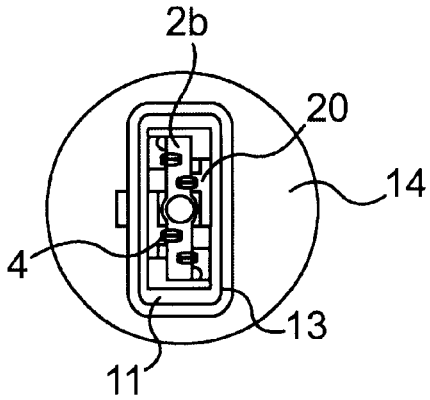

FIGS. 2, 3, 4(*a*) and 4(*b*) are illustrations for explaining the fitting structure of the wedge-base lamp 1 and the socket 10. The peripheral portion 14 can be integrally formed with the insertion portion 12 and the rear end portion 13, and fixed to a housing of, for example, a vehicle lamp fitting. In this embodiment, a fixation piece 14*a* having a hook structure and a sealing rubber 14*b* can be provided, to thereby fix the peripheral portion 14 to a housing or the like (not shown). The rear end portion 13 can be hollow inside, and an opening 11 continuous from the insertion portion 12 can be formed therein.

It is preferred that the opening provided in the rear end portion 13 be equal to or larger than the opening in the insertion portion 12. This arrangement facilitates the forming of the pushing piece 16 (with hook structure) by a mold so that the mold can be easily released from the rear end portion 13 side, via the opening 11. The socket 10 can be made from a resin or the like.

The socket 10 can be constructed as described above, and the wedge-base lamp can be inserted and fitted into the opening 11 from the insertion portion 12 side to be secured. With regard to the wedge-base lamp 1, since it has basically the same construction as described above, the same reference numerals are given to the same parts, and detailed description thereof is omitted. However, an example using a wedge-base lamp of a so-called double filament type having two filaments 5 provided therein is shown here.

When the fixed portion 2*b* of the wedge-base lamp 1 is inserted into the opening 11 of the socket insertion portion 12, the bottom face of the fixed portion 2*b* abuts against the bottom positioning protrusions 18 at two positions disposed at diagonal comers inside the opening on the rear end portion side of the insertion portion 12. The raising wall 15 can be formed in a dimension having a slightly smaller opening 11 compared to the dimension in the width direction of the insertion portion 12. Thus, insertion of the wedge-base lamp 1 slightly enlarges the raising wall 15 at positions of the side slits 17, and the fixed portion 2*b* is clamped by the spring property of the material to thereby effect fixation.

Further more, since the pushing pieces 16 formed on the raising wall 15 have pushing piece slits 16*a* on opposite sides thereof, protrusions 3 in a substantially triangular shape in section formed in the fixed portion 2*b* of the wedge-base lamp 1 can be easily inserted into the opening 11, to thereby effect positioning and fixation by means of a hook 16*b* disposed at the tip of the pushing piece 16. The slit size of the side slits 17 and the pushing piece slits 16*a* are to be an optimum size, in accordance with a number of factors, including: material being used, the force for inserting the wedge-base lamp, the clamping force and the like. However, when the depth is at least ½ or more, and more preferably approximately two thirds, of the height of the fixed portion 2*b* of the wedge-base lamp, molding becomes easier to accomplish and becomes a preferable method of manufacture. Hence, for example, the slits are preferably formed in a depth of 8 mm, with a width of 0.4 to 0.8 mm.

The wedge-base lamp 1 can be fixed to the socket 10 in the above manner. Since the opening 11 of the socket 10 can be provided continuously up to the rear end portion 13, the fixed portion 2*b* of the wedge-base lamp 1 can be directly observed, as shown in FIG. 4(*b*), as seen from the rear end portion 13 in the inserted condition. Moreover, the lead wire 4 and the inner surface of the opening 11 in the rear end portion 13 can be fixed so as to have a gap 20 therebetween, and a feed terminal 22 of the connector 21 can be electrically connected to the lead wire 4 to thereby perform electrical feeding.

Figure 5:
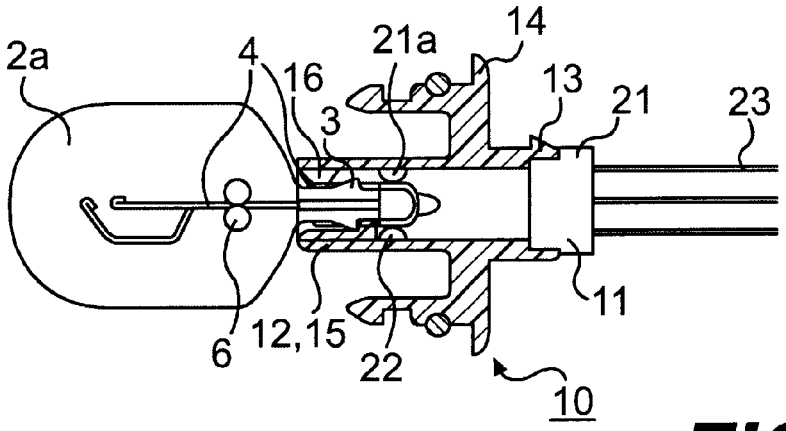
FIG. 5 is a schematic sectional view of the connector in the fitting structure of the socket of FIG, 1.

FIG. 5 is an illustration for explaining the construction of the fitting state of the wedge-base lamp 1 fixed in the socket 10 and the connector 21. The connector 21 can be detachably attached by inserting the connector into the opening 11 provided in the rear end portion 13 of the socket 10. The shape of the tip portion 21 a can be substantially the same shape as that of the gap 20, and the tip portion 21*a* can include a feed terminal 22. Therefore, insertion of the connector 21 effects direct connection of the feed terminal 22 and the lead wire 4 of the wedge-base lamp 1. In a state in which the connector 21 is not attached. since there is a gap 20, the assembled state is slightly loose when the socket 10 and the wedge-base lamp 1 are fitted together. However, by fixing the connector 21, the loose state can be reduced. Reference numeral 23 denotes an electrical wire.

The fitting structure of the present invention is as described above. and does not require a feed terminal in the socket. That is to say. the socket 10 performs positioning and fixation of the wedge-base lamp 1, and the connector 21 fitted into the socket performs electrical feeding and further fixation. Therefore, an electrode terminal for the wedge base that becomes a joint for connection as in the conventional case is not required, thereby enabling reduction in the depth dimension.

Moreover, a strong fixation structure can be provided wherein an even stronger fitting is possible by fitting the connector, as compared to the fixed state at the time of fitting the wedge-base lamp into the socket. The fitting operation can be easily performed.

Figure 6:
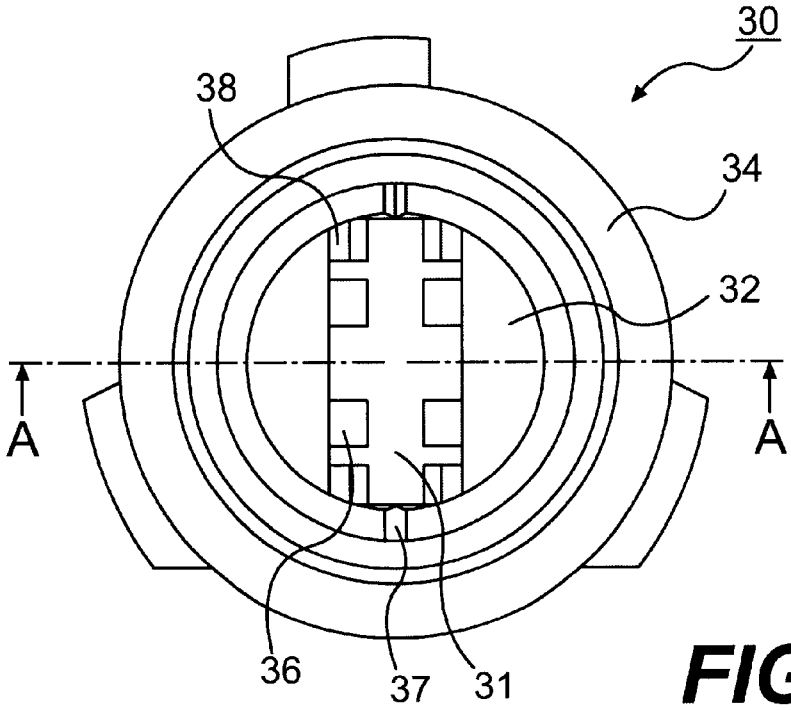
FIG. 6 is a schematic plan view of a socket of another embodiment of the present invention.
Figure 7:
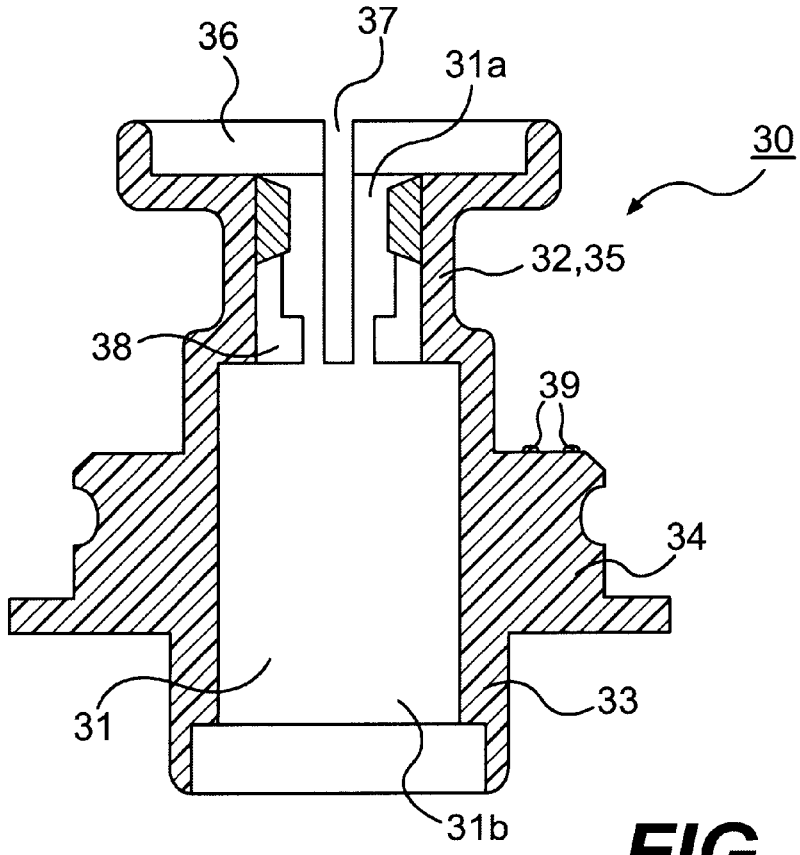
FIG. 7 is a schematic sectional view of the socket taken along line A—A in FIG. 6.
Figure 8:
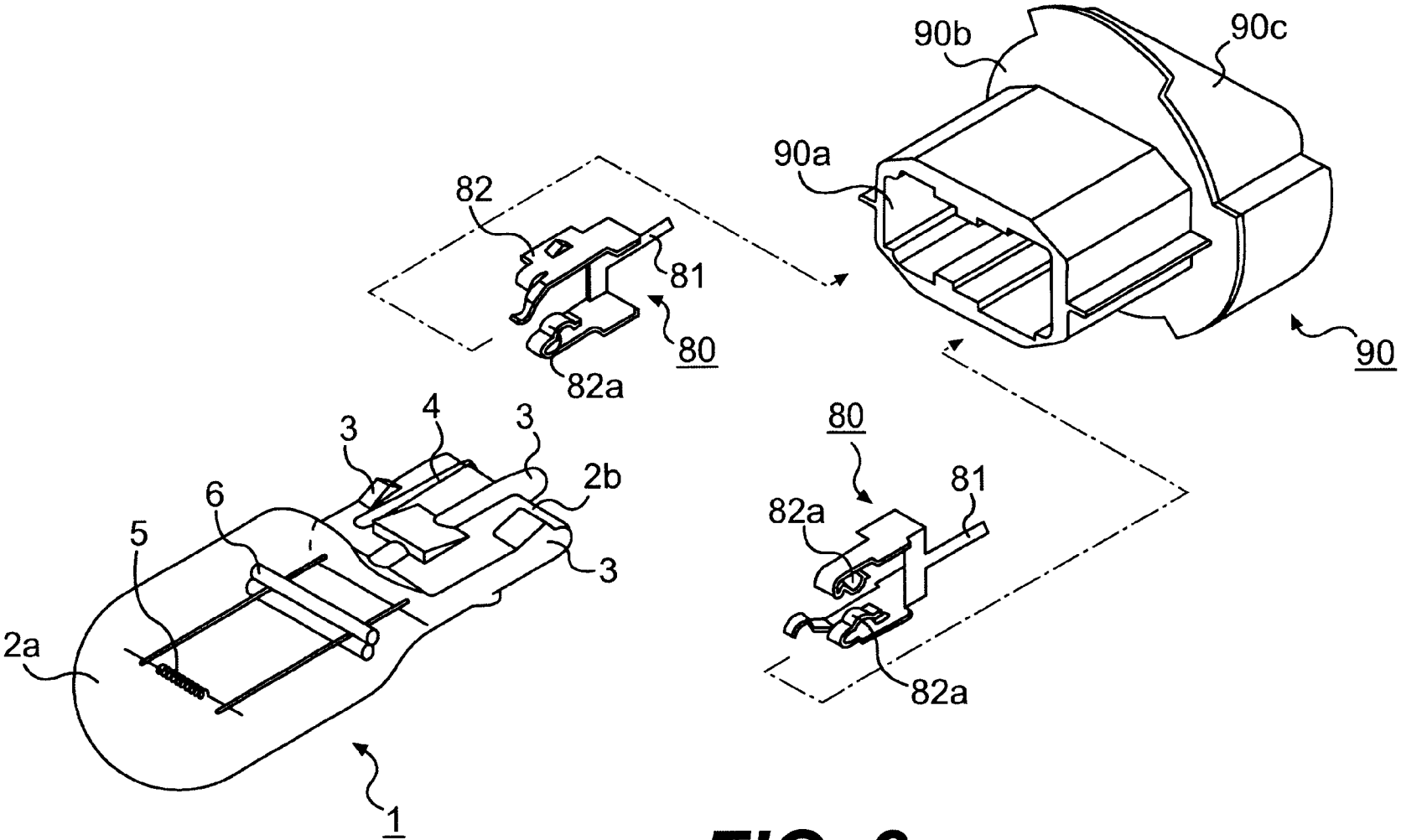
FIG. 8 CONVENTIONAL ART
FIG. 8 is a schematic exploded perspective view of a conventional wedge-base lamp and socket.
Figure 9:
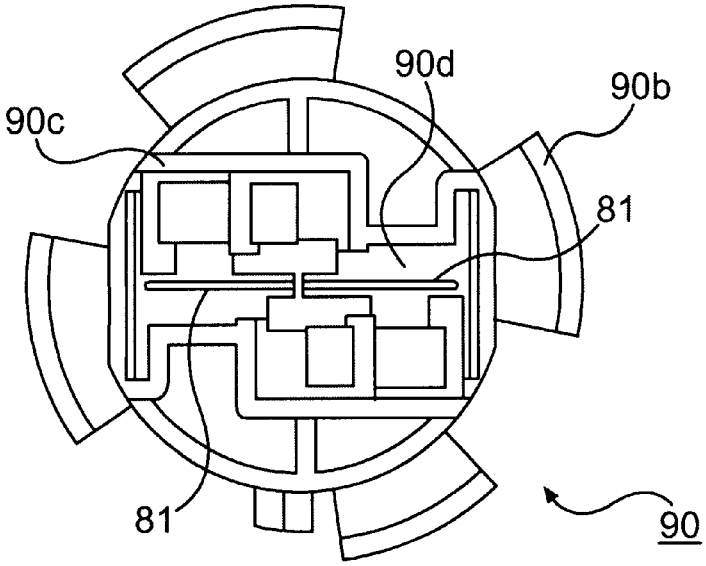
FIG. 9 CONVENTIONAL ART
FIG. 9 is a schematic sectional view of the fitting structure of FIG. 8.
Figure 10:
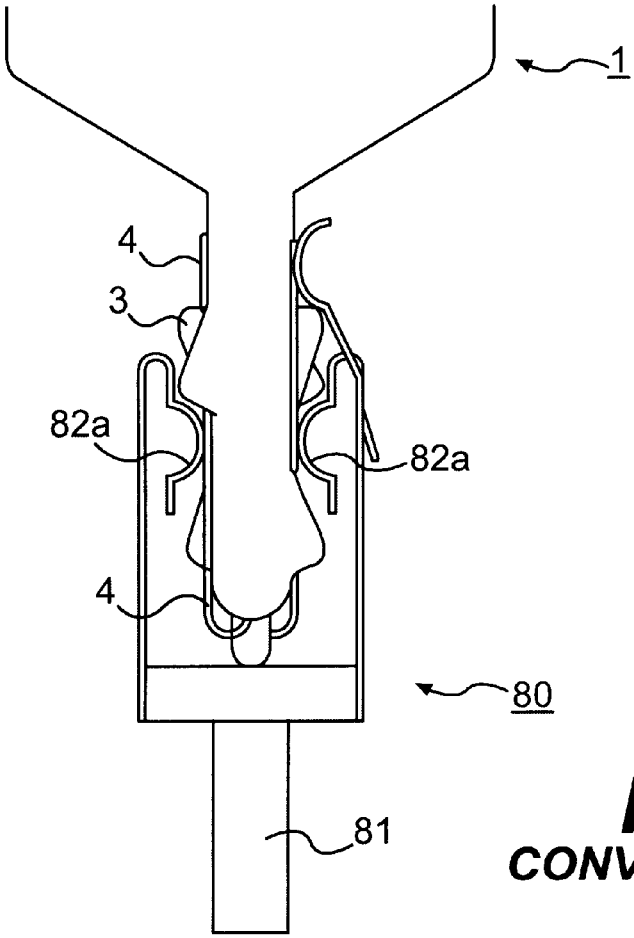
FIG. 10 CONVENTIONAL ART
FIG. 10 is a partial side view of the socket and lamp of FIG. 8.

FIG. 6 and FIG. 7 are a plan view and a sectional view, respectively, showing the insertion portion side of a socket according to another embodiment of the present invention, wherein reference numeral 30 denotes the socket.

The socket 30 of the embodiment of FIGS. 6 and 7 can include an insertion portion 32 for fitting a wedge-base lamp, a rear end portion 33, an outer peripheral portion 34. and an opening 31 formed from the insertion portion 32 up to the rear end portion 33.

The insertion portion 32 can be formed such that a raising wall 35 having an oblong rectangular shape is integrally formed with an outer peripheral portion 34, with the insertion side (the upper side in FIG. 7) of the wedge-base lamp being enlarged. In the opening 31*a* in the insertion portion 32, pushing pieces 36 at two positions on the lamp insertion side, and bottom positioning protrusions 38 disposed at four comers on the rear end 33 side can be provided at prescribed locations of respective long sides of the raising wall 35. Moreover, side slits 37 can be formed on the narrow sides of the raising wall 35. The pushing pieces 36 and the bottom positioning protrusions 38 are preferably provided in a prescribed location alternately so as not to align linearly with respect to the lamp insertion direction, thereby enabling easy molding without performing complicated processing or the like to the mold.

The peripheral portion 34 and the rear end portion 33 can be formed of PET resin integrally with the insertion portion 32. Opening 31 can have an opening 31*a* of a dimension approximately corresponding to and fitted with the fixed portion of the wedge-base lamp on the insertion portion 32 side, and an opening 31*b* having a larger sectional area than that of opening 31*a*, at the rear end portion 33.

An identification mark 39 can be formed on the peripheral portion 34, and can include two protrusions for identifying that the lamp to be fitted is, for example, a double-filament type wedge-base lamp.

When a wedge-base lamp as described above (not shoots) is inserted from the insertion portion 32 side into the thus constructed socket 30, four corners at the bottom of the lamp fixed portion abut against the bottom positioning protrusions 38. The pushing pieces 36 are configured to clamp and secure the fixed portion 2*b* from above the lead wire folded onto the lamp fixed portion. As a result, the wedge-base lamp is positioned and secured respectively from four directions at the bottom and the upper part of the fixed portion 2*b*, and hence the wedge-base lamp is strongly fixed with little resulting torsion forces.

Furthermore, an unillustrated connector can be inserted from the opening 31*b* side where the inner area on the rear end portion 33 side can be formed relatively large, to thereby electrically connect the feed terminal of the connector and the lead wire 4 in a gap at the side face of the opening 31*a*.

Also in this embodiment, a terminal for feeding power to the socket 30 is not provided. The socket 30 performs positioning and fixation of the wedge-base lamp, and the connector fitted into the socket performs electrical feeding and further fixation. Therefore, an electrode terminal for the wedge base that acts as a connection joint as in the conventional case is not required thereby enabling reduction in the depth dimension. Thus, a strong fixation structure can be provided wherein further stronger fitting is possible by fitting the connector, such that the fitting is stronger as compared to the fixed state at the time of fitting the wedge-base lamp into the socket. In addition, the fitting operation can be easily performed.

In the above-described embodiments, an example using a double-filament type wedge-base lamp has been described. However, the present invention is not limited to this example. For example, a single filament type having different numbers of lead wires and/or other lamp configurations can also be used.

The above-described embodiments are preferable specific examples of the present invention, and various features that are technically preferable are added. However, the scope of the present invention is not limited to these aspects. For example, a case where the socket is not provided with a peripheral portion 14 or 34, or where a peripheral portion having a bayonet structure is provided, or where various modifications are performed such as providing three or more bottom positioning protrusions and/or pushing pieces on the inner face of the opening, respectively, can also be included in the scope of the present invention.

As described above, according to the present invention, since the wedge-base lamp is fixed by the socket, and the connector is inserted and fitted into the socket from the rear end side to thereby effect direct electrical connection between the wedge-base lamp and the feed terminal disposed in the connector and to provide filter fixation, the space disposed on the rear side of the fixed portion of the wedge-base lamp can be made small. As a result, a fitting structure having a small depth dimension can be provided. In addition, since there is no need for providing an electrical terminal in the socket, the number of parts can be reduced, and in general, a low cost fitting structure can be provided.

The wedge-base lamp need not be provided with a base, and the difference in the type of lamp, such as whether the wedge-base lamp is a double-filament type or a single-filament type, is determined by the difference in the protrusion shape of the fixed portion. However, since the fixed. portion is integrally formed of glass, there may be a case where the lamp connection point is not recognized properly, causing a problem in that a wrong fitting operation may be performed, However, it is possible to provide an identification mark such as characters, colors or the like for recognizing the type of lamp that is to be fitted to the socket, thus preventing incorrect assembly.

Furthermore, the fixed portion of the wedge-base lamp can be identically shaped as conventional lamps, thereby enabling fitting without subjecting the lamp to additional machining.

While there have been described what are presently considered to be preferred embodiments of the invention, it will be understood that various modifications may be made thereto, and it is intended that the appended claims cover all such modification as fall within the true spirit and scope of the invention.

What is claimed is:

1. A lamp fitting structure, comprising:

a lamp having a bulb portion, a fixed portion having a length and width, the fixed portion having no base, and a lead wire located at the fixed portion;

a socket including an insertion portion for receiving and fitting the fixed portion therein, and a rear end portion; and a connector made of insulative material and configured to be inserted and fitted into the rear end portion of the socket;

wherein the insertion portion located on the socket includes a back side, a narrow side and a cylindrical opening having a length that is substantially the same as the length of the fixed portion of the lamp, the rear end portion is provided on the back side of the insertion portion, and the opening is located in the rear end portion, a side slit is formed on the narrow side of the insertion portion, a plurality of pushing pieces and positioning protrusions are provided in the opening such that when the fixed portion of the lamp is inserted into the opening in the insertion portion, the pushing pieces and positioning protrusions abut against the fixed portion of the lamp, and the fixed portion forms a gap with an inner face of the opening of the insertion portion to house the lead wire, and the connector includes a feed terminal, the feed terminal is configured to be inserted ad fitted into the gap through the opening in the rear end portion, to thereby connect the feed terminal provided in the connector to the lead wire.

2. The lamp fitting structure in according to claim 1, wherein the insertion portion includes at least one long side and the pushing piece is provided in the at least one long side of the insertion portion, and the positioning protrusions are provided on the rear end portion, each of the positioning protrusions and pushing pieces extend into the opening, and each pushing piece extends farther into the opening than each positioning protrusion.

3. The lamp fitting structure according claim 1, wherein the opening is configured such that a sectional area of the rear end portion taken perpendicular to a longitudinal axis of the rear end portion is larger than a sectional area of the insertion portion taken perpendicular to a longitudinal axis of the insertion portion.

4. The lamp fitting structure according claim 1, wherein the cylindrical opening is rectangular.

5. The lamp fitting structure according claim 1, wherein the lamp is a wedge-base lamp.

6. The lamp fitting structure according to claim 1, wherein the insertion portion and the rear end portion are integrally formed of an elastic resin material.

7. The lamp fitting structure in according to claim 6, wherein the insertion portion includes at least one long side and the pushing piece is provided in the at least one long side of the insertion portion, and the positioning protrusions are provided on the rear end portion, each of the positioning protrusions and pushing pieces extend into the opening, and each pushing piece extends farther into the opening than each positioning protrusion.

8. The lamp fitting structure according claim 6, wherein the opening is configured such that a sectional area of the rear end portion taken perpendicular to a longitudinal axis of the rear end portion is larger than a sectional area of the insertion portion taken perpendicular to a longitudinal axis of the insertion portion.

9. The lamp fitting structure according to claim 6, wherein the depth of the side slit is substantially two thirds of the height of the fixed portion of the lamp.

10. The lamp fitting structure according claim 9, wherein the opening is configured such that a sectional area of the rear end portion taken perpendicular to a longitudinal axis of the rear end portion is larger than a sectional area of the insertion portion taken perpendicular to a longitudinal axis of the insertion portion.

11. The lamp fitting structure in according to claim 9, wherein the insertion portion includes at least one long side and the pushing piece is provided in the at least one long side of the insertion portion, and the positioning protrusions are provided on the rear end portion, each of the positioning protrusions and pushing pieces extend into the opening, and each pushing piece extends farther into the opening than each positioning protrusion.

12. The lamp fitting structure according claim 11, wherein the opening is configured such that a sectional area of the rear end portion taken perpendicular to a longitudinal axis of the rear end portion is larger than a sectional area of the insertion portion taken perpendicular to a longitudinal axis of the insertion portion.

13. A lamp fitting socket configured to receive a lamp that includes a bulb portion, a fixed portion having no base, and a lead wire located at the fixed portion, comprising:

an insertion portion for receiving and fitting the fixed portion of the lamp therein, the insertion portion including a back side, a narrow side, a long side and an opening;

a connector made of insulative material;

a rear end portion provided on the back side of the insertion portion configured for received the connector and including the opening;

a side slit formed on the narrow side of the insertion portion; and a pushing piece and a positioning protrusion provided in the opening such that when the fixed portion of the lamp is inserted into the opening in the insertion portion, the pushing piece and positioning protrusion abut against the fixed portion of the lamp, and a gap is formed between an inner face of the opening of the insertion portion and the fixed portion of the lamp to house the lead wire, whereby the connector can be inserted and fitted into the gap through the opening in the rear end portion to thereby connect a feed terminal provided in the connector to the lead wire.

14. The lamp fitting structure according to claim 13, wherein the insertion portion and the rear end portion are integrally formed of a resin material.

15. The lamp fitting structure in according to claim 13, wherein the insertion portion includes at least one long side and the pushing piece is provided in the at least one long side of the insertion portion, and the positioning protrusions are provided on the rear end portion, each of the positioning protrusions and pushing pieces extend into the opening, and each pushing piece extends farther into the opening than each positioning protrusion.

16. The lamp fitting structure according claim 13, wherein the opening is made such that the sectional area of the rear end portion taken perpendicular to a longitudinal axis of the rear end portion side is larger than the sectional area of the insertion portion taken perpendicular to a longitudinal axis of the insertion portion.

17. The lamp fitting structure according to claim 13, wherein the depth of the side slit is substantially two thirds of the height of the fixed portion of the lamp.

18. The lamp fitting structure according claim 13, wherein the opening is rectangular.

19. The lamp fitting structure according claim 13, further comprising a plurality of pushing pieces and positioning protrusions.

20. The lamp fitting structure according claim 13, wherein the lamp is a wedge-base lamp.

* * * * *